US011186956B1

(12) United States Patent
Bazey et al.

(10) Patent No.: US 11,186,956 B1
(45) Date of Patent: Nov. 30, 2021

(54) DOWEL ASSEMBLY ALIGNMENT APPARATUS AND METHOD

(71) Applicant: Simplex Supplies, Inc., Minneapolis, MN (US)

(72) Inventors: Sarah Bazey, Henderson, NV (US); Manuel Gonzalez, Sparks, NV (US)

(73) Assignee: SIMPLEX SUPPLIES, INC., Minneapolis, MN (US)

( * ) Notice: Subject to any disclaimer, the term of this patent is extended or adjusted under 35 U.S.C. 154(b) by 93 days.

(21) Appl. No.: 16/828,360

(22) Filed: Mar. 24, 2020

Related U.S. Application Data

(60) Provisional application No. 62/824,763, filed on Mar. 27, 2019.

(51) Int. Cl.
*E01C 11/00* (2006.01)
*E01C 11/14* (2006.01)
*E01C 11/06* (2006.01)

(52) U.S. Cl.
CPC ..... *E01C 11/14* (2013.01); *E01C 11/06* (2013.01)

(58) Field of Classification Search
CPC ..... E01C 11/06; E01C 11/14
USPC ..... 404/46–70, 72, 75, 134–136
See application file for complete search history.

(56) References Cited

U.S. PATENT DOCUMENTS 6,171,016 B1 * 1/2001 Pauls ..... E01C 11/14 404/59
6,210,070 B1 * 4/2001 Shaw ..... E01C 11/14 404/62
7,553,554 B2 6/2009 Miller
7,748,928 B2 * 7/2010 Estes ..... E01C 11/14 404/58
9,476,165 B2 10/2016 Schenk
9,611,593 B2 4/2017 Schenk

OTHER PUBLICATIONS

Eder, Glenn, "Dowel Basket Standardization Update & New Considerations", Simplex / JC Supply and Manufacturing, Jul. 2018.

* cited by examiner

*Primary Examiner* — Raymond W Addie
(74) *Attorney, Agent, or Firm* — Mai-Tram D. Lauer; Westman, Champlin & Koehler, P.A.

(57) ABSTRACT

In one aspect, a dowel is configured to join two adjacent concrete sections. The dowel includes a cylindrical rod having a length and a reflective marker disposed on the cylindrical rod at a midpoint of the length. The dowel is attached to a basket proximate one of the ends.

10 Claims, 4 Drawing Sheets

DOWEL ASSEMBLY ALIGNMENT APPARATUS AND METHOD

CROSS REFERENCE TO RELATED APPLICATION

This application claims the benefit of priority of U.S. Provisional Patent Application No. 62/824,763, filed on Mar. 27, 2019, for "Dowel Assembly Alignment Apparatus and Method," which is hereby incorporated by reference in its entirety.

BACKGROUND

In the construction of concrete road surfaces, provisions should be made for the inherent tendency of concrete to expand and contract in response to changes in environmental factors such as temperature. FIG. 1 is a perspective view of a poured concrete road 12 under construction, wherein joint lines 10 have been cut into and through at least a portion of the thickness of the concrete road 12. The joint cut lines 10 demarcate separations between road sections 14. Joint cut lines 10 remove enough material between adjacent sections 14 to allow each section 14 to expand and contract while minimizing uncontrolled cracking of the concrete material. However, unrestrained motion may cause adjacent sections 14 to not only move horizontally, but also vertically, possibly resulting in an undesired heaving or difference in elevation between adjacent sections 14 at joint cut line 10. To tie the edges of adjacent sections 14 together and thereby prevent differences in height at joint cut line 10 due to movement of the concrete, rows 16 of steel dowels are laid on the road bed 18 prior to pouring the concrete. As illustrated in FIG. 1, it is important to align the rows 16 of dowels with the joint cut line 10 to ensure that adjacent sections 14 on both sides of joint cut line 10 are attached to each other.

FIG. 2 is a perspective view of a single row 16 of steel dowels laid upon the road bed 18, and having concrete 32 poured thereon. Each of the dowels 20 is supported by a cradle or basket 22 to support the dowel 20 above the surface of the road bed 18. In an exemplary embodiment, the dowel 20 is held above the road bed 18 at a height that is approximately half of the finished thickness of the concrete road. Accordingly, the dowel 20 will span the joint cut line 10 at about a midpoint in the thickness of the road 12.

As shown in FIG. 1, the direction of joint cut line 10 is shown by arrow 24, as being transverse to a direction of travel of a vehicle over the road 12. As shown in FIG. 2, each of the dowels 20 is aligned in direction 26, which is substantially perpendicular to direction 24. An assembly of road 12, dowels 20 and baskets 22 is configured to allow the road sections 14 to move in direction 26, thereby sliding along direction 26 around the encased dowels 20. However, the presence of the dowels 20 prevents adjacent road sections 14 from moving with respect to each other in any direction other than the sliding direction 26. Accordingly, the dowels 20 maintain the smoothness of the road 12 across joint cut lines 10.

SUMMARY

In one aspect, a dowel is configured to join two adjacent concrete sections. The dowel includes a cylindrical rod having a length and a reflective marker disposed on the cylindrical rod at a midpoint of the length. The dowel is attached to a basket proximate one of the ends.

This summary is provided to introduce concepts in simplified form that are further described below in the Detailed Description. This summary is not intended to identify key features or essential features of the disclosed or claimed subject matter and is not intended to describe each disclosed embodiment or every implementation of the disclosed or claimed subject matter. Specifically, features disclosed herein with respect to one embodiment may be equally applicable to another. Further, this summary is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

The disclosed subject matter will be further explained with reference to the attached figures, wherein like structure or system elements are referred to by like reference numerals throughout the several views. It is contemplated that all descriptions are applicable to like and analogous structures throughout the several embodiments.

Figure 1:
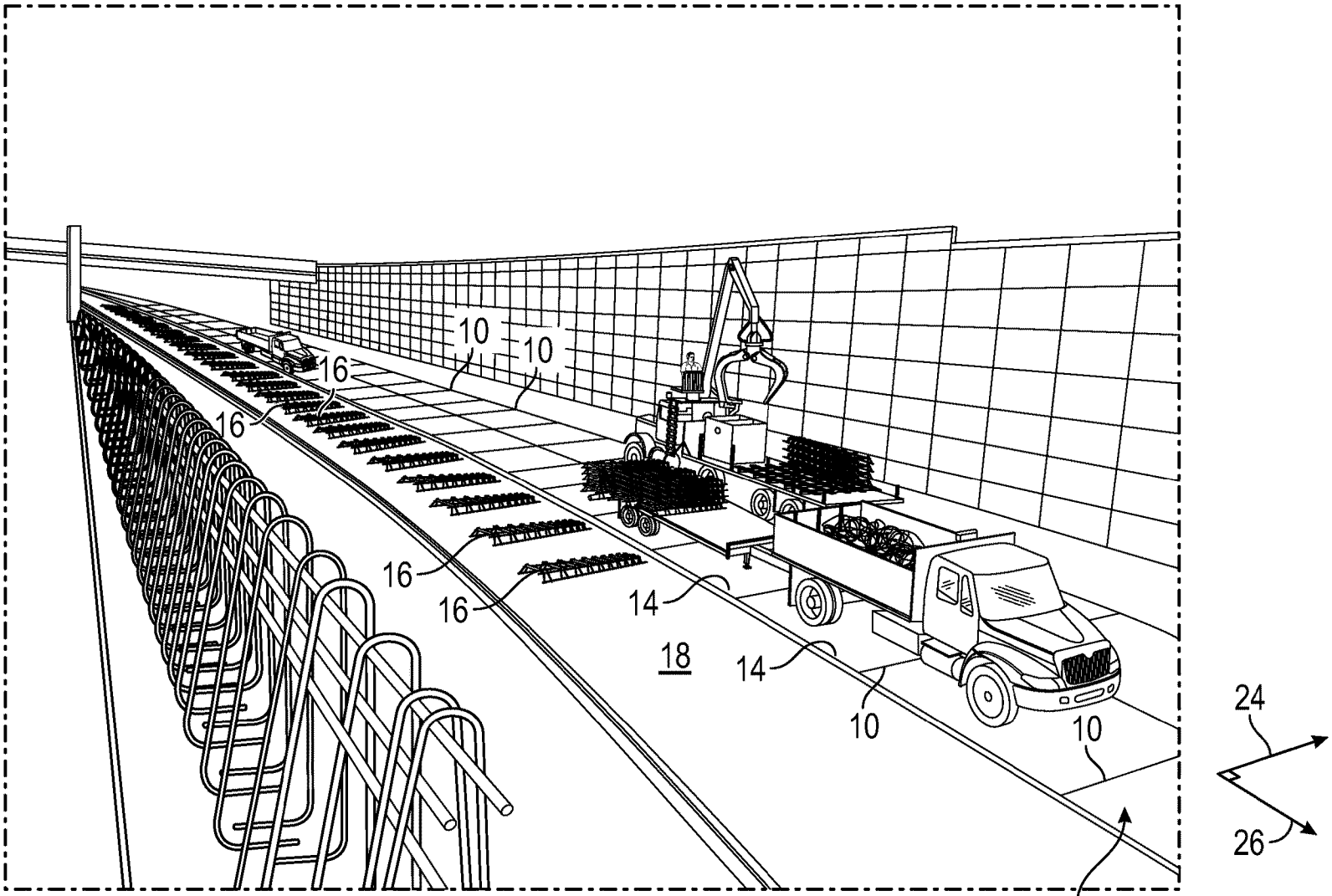
FIG. 1 (Prior Art)
FIG. 1 is a perspective view of rows of steel dowels being conventionally aligned with joint cut lines in a road under construction.

While the above-identified figures set forth one or more embodiments of the disclosed subject matter, other embodiments are also contemplated, as noted in the disclosure. In all cases, this disclosure presents the disclosed subject matter by way of representation and not limitation. It should be understood that numerous other modifications and embodiments can be devised by those skilled in the art that fall within the scope of the principles of this disclosure.

The figures may not be drawn to scale. In particular, some features may be enlarged relative to other features for clarity. Moreover, where terms such as above, below, over, under, top, bottom, side, right, left, vertical, horizontal, etc., are used, it is to be understood that they are used only for ease of understanding the description. It is contemplated that structures may be oriented otherwise.

DETAILED DESCRIPTION

For the steel dowels 20 to perform their function properly, it is important to align the row 16 of dowels 20 with a joint cut line 10 of the road 12. Typically, workers attempt to align the row 16 with markings 30 placed on the road bed 18, such as spray-painted markings, for example. However, because a typical basket 22 is relatively short, it can be difficult to connect adjacent baskets together while keeping the row 16 straight. Accordingly, the present application describes a dowel assembly alignment feature to address this problem.

Figure 3:
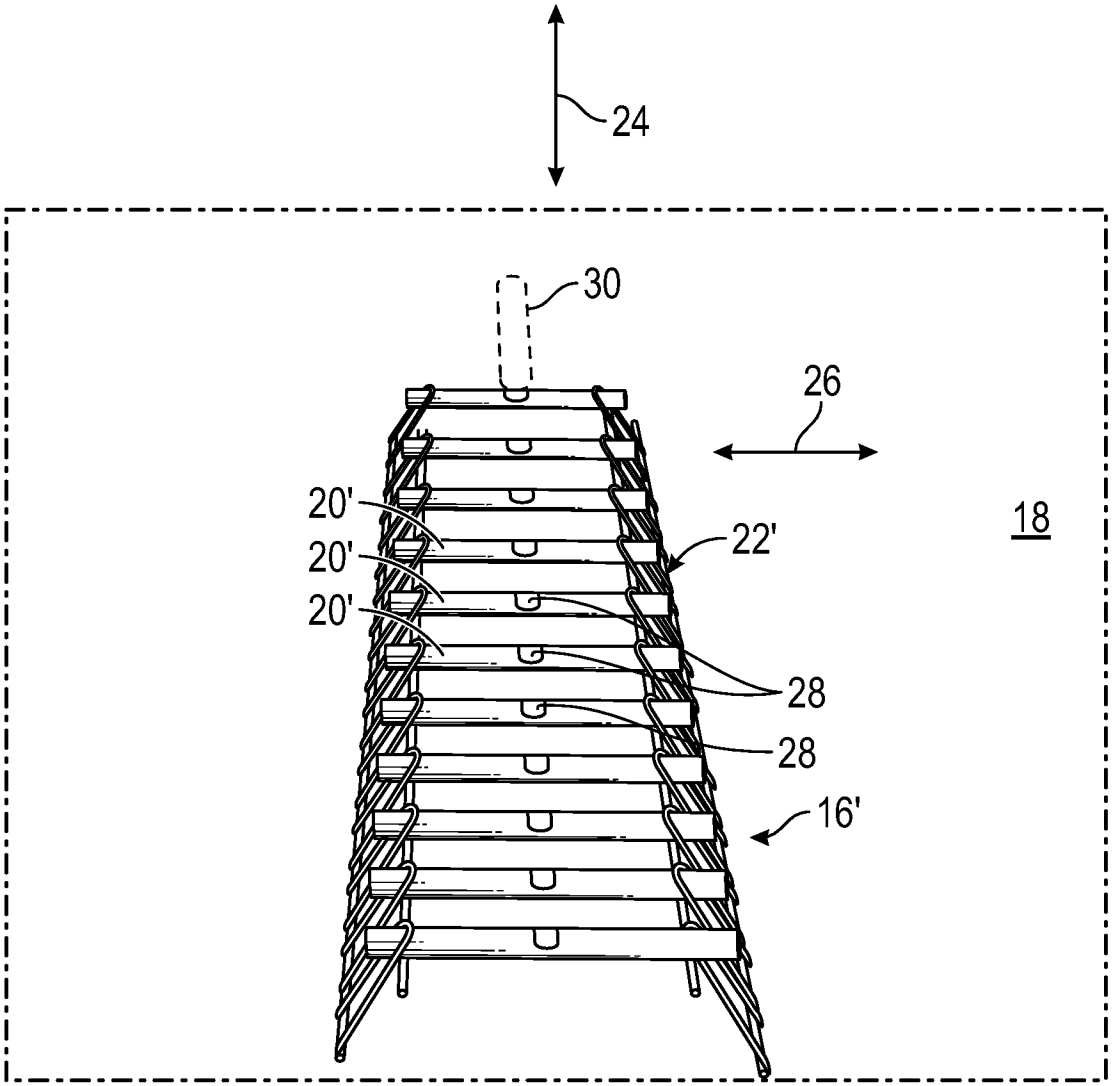
FIG. 3 is an end perspective view of a row of steel dowels embodying an alignment feature of the present disclosure.

To prevent road construction from unduly tying up traffic, some of the construction is performed at times and under conditions when poor light leads to low visibility, such as in the early morning hours, in the evening, and even during the dark of night. The dowel assembly alignment apparatus and methods of the present disclosure are configured to increase dowel placement accuracy and ease of use in such lightless or low light conditions. FIG. 3 is an end perspective view of a basket 22' supporting generally parallel dowels 20', each of which includes an exemplary reflective alignment stripe 28. As shown in FIG. 3, each of reflective alignment stripes 28 is aligned with a marker 30 provided on road bed 18. While marker 30 is illustrated as a stripe of spray paint, other known markers include stakes with ribbons, tape or flags, for example.

In one embodiment, reflective alignment stripe 28 is provided at a longitudinal (in direction 26) midpoint of each of the dowels 20'. In an exemplary embodiment, each reflective alignment stripe 28 includes material that is easily visible in low-light conditions due to its prismatic, reflective, retro-reflective, fluorescent or luminescent properties. Reflective alignment stripe 28 can be disposed on dowel 20' in many forms, including a coating such as a paint or an applied layer such as tape, for example. In an exemplary embodiment, the reflective alignment stripe 28 is provided as a paint coating of fluorescent orange paint, commercially available from Valspar Corporation of Minneapolis, Minn., under product code 82012. In exemplary embodiments, upon shining a visible light source on reflective alignment stripe 28, an increase in visibility of the reflective alignment stripe 28 perceived by a human eye is greater than an increase in visibility of a finish of dowel 20' that is not covered by reflective alignment stripe 28. Many sources of artificial illumination can be used, such as contractor lights, flashlights, head lamps, and construction site lights. For example, a material for forming reflective alignment stripe 28 may have properties including retroreflectivity, chemiluminescence, phosphorescence, radioluminescence, or other luminescence. Moreover, in an exemplary embodiment, each reflective alignment strip 28 is visually distinct from other portions of dowel 20', so that its alignment function is not fully dependent on the light reflective properties, but can also be characterized by a visually contrasting color. In yet another embodiment, each reflective alignment stripe 28 may have a different surface texture than adjacent portions of its respective dowel 20', in order to enhance visibility of reflective stripe 28.

In one manufacturing embodiment, a reflective alignment stripe 28 is provided on a dowel 20' before the dowel is secured in a basket 22'. However, in another case, the reflective alignment stripe 28 is applied to a dowel 20' after the dowel 20' has been fixed to a basket 22' such as by welding. Generally, it is sufficient that the reflective alignment stripe 28 cover only a portion (such as a top surface) of the dowel 20'. For example, a coverage of approximately 45 percent of the circumference of the top side of each dowel 20' has been demonstrated as being sufficient for providing the alignment function. Referring to FIG. 3, only one end of each dowel 20' is welded to basket 22' so that at least partial sliding motion of dowel 20' along direction 26 is still possible, relative to adjacent portions of basket 22'. In an exemplary embodiment, adjacent dowels 20' are attached to basket 22' at alternating, opposite ends.

Figure 2:
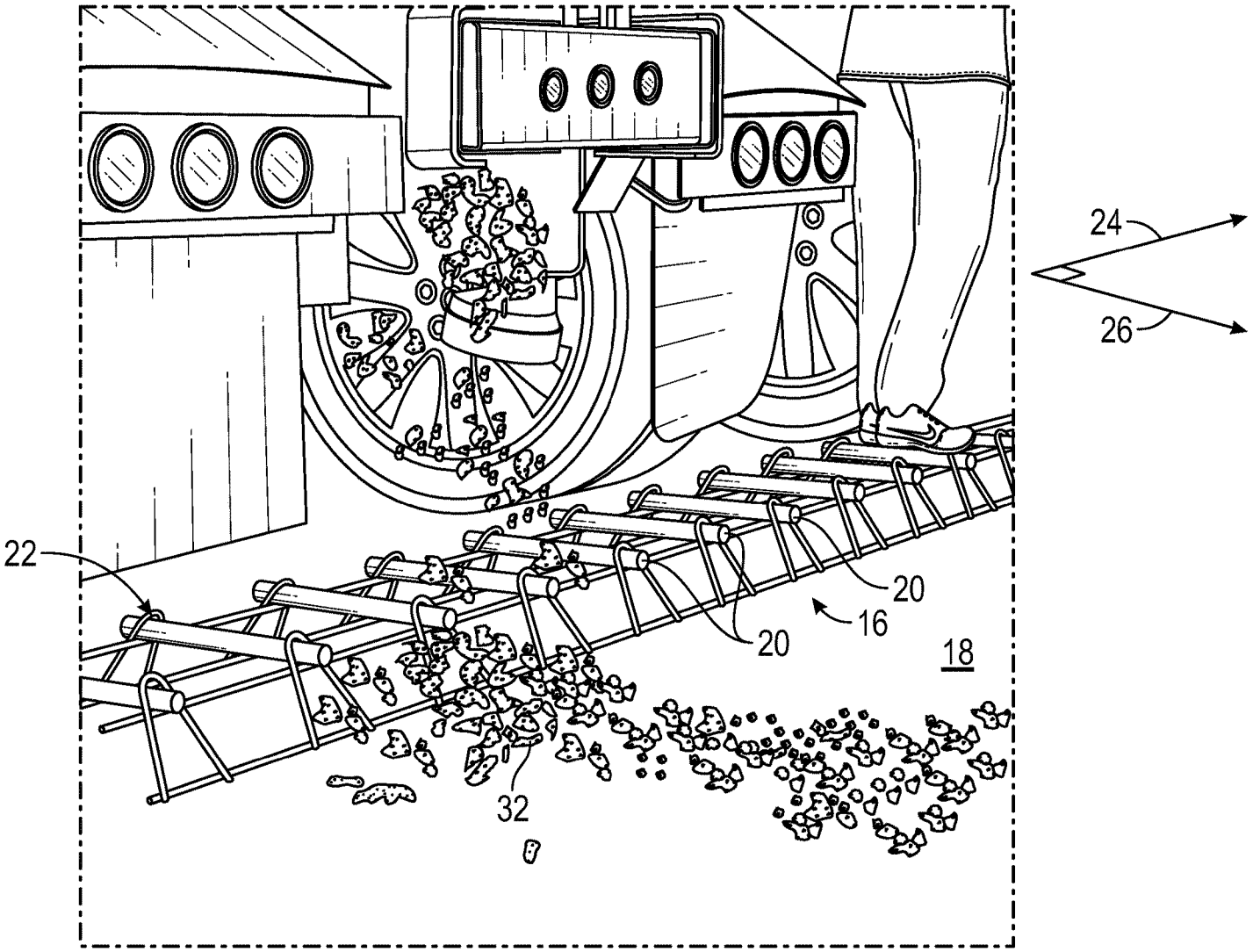
FIG. 2 (Prior Art)
FIG. 2 is a perspective view of concrete being conventionally poured over a row of steel dowels.

In an exemplary embodiment, each reflective alignment stripe 28 has a width of about 0.25 inches along direction 26 (where a typical dowel length is about 18 inches long in direction 26). However, it is contemplated that other dimensions may also be suitable. As shown in FIG. 3, the provision of reflective alignment stripe 28 allows a user to easily position dowels 20' so that their midpoints are provided in a straight line relative to a marker. While a marker 30 is illustrated as a painted mark, it could also be another feature, such an already cut joint line 10 on a previously laid lane of the road, for example. Moreover, the reflective alignment stripe 28 makes it easy for a supervisor or inspector to confirm that the dowels 20' are properly aligned. Additionally, where multiple baskets 22' are aligned end-to-end to form a longer row 16', the reflective alignment stripes 28 provide a visual indication of the alignment of the dowels 20' in the row 16', which is more easily discernible than merely looking at unmarked dowels, as in FIG. 2.

For example, a typical length (in direction 24) of basket 22' is about 12 feet. For a typical 2-car lane width of concrete that is 28 feet wide, or for a wider 40-feet wide road expanse, two or three baskets 22' would be lined up along direction 24. In a method of use, workers find a marker 30 on the road bed and align baskets 22' so that reflective alignment stripes 28 are provided in a straight line with marker 30, as shown in FIG. 3. The workers can shine a light on reflective alignment stripes 28 to increase the visibility of the reflective alignment stripes 28 compared to the remainder of dowels 20'. Thus, the disclosed apparatus and methods allow workers and inspectors more easily set the dowels 20' in a straight line relative to road bed markers 30 and check for their proper positioning during road construction work in low light conditions.

Figure 4:
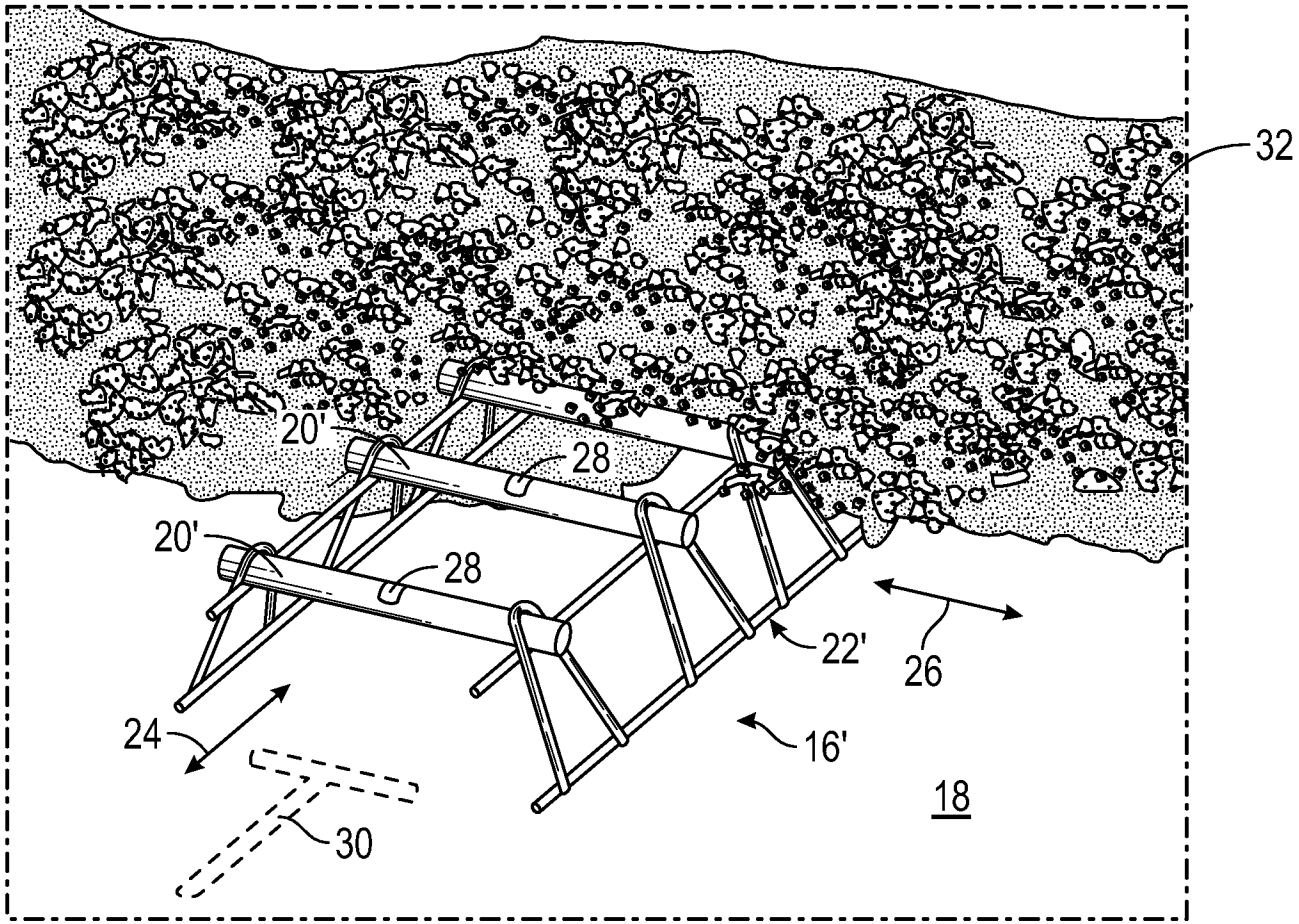
FIG. 4 is a perspective view of an end of the row of FIG. 3, showing the row partially covered in concrete.

FIG. 4 is a perspective view of dowels 20' having a reflective alignment stripe 28 of the present disclosure, wherein some of the dowels 20' of the basket 22' are being encased in poured concrete 32. After the concrete sets to a sufficient degree to allow workers to walk on it (e.g., in a "green" state), workers cut joint line seams 10 into the solid concrete above reflective alignment stripes 28 on the dowels 20'. Dowels 20 'extend between the concrete sections 14 below such seams 10, thereby carrying weight from one slab section 14 to another slab section 14 across the seam 10. A surface of dowel 20' is smooth, so that the concrete can slide about the dowel 20' in direction 26, allowing the dowel 20' to perform as a load transfer dowel between connected sections 14. Joint cut line 10 in a typical application is about 1.5 inches deep on a road 12 that has a concrete depth of about 10 inches. Typically, dowels 20' are placed at a mid-point with respect to the depth of the road 12 (about 5 inches above the road bed 18 and about 5 inches below the road surface).

Although the subject of this disclosure has been described with reference to several embodiments, workers skilled in the art will recognize that changes may be made in form and detail without departing from the scope of the disclosure. In addition, any feature disclosed with respect to one embodiment may be incorporated in another embodiment, and vice-versa.

The invention claimed is:

1. An apparatus including:

a dowel configured to join two adjacent concrete sections, the dowel including:

a cylindrical rod having a length between two opposite ends; and a reflective marker disposed on the cylindrical rod at a midpoint of the length; and a basket to which the dowel is attached proximate one of the ends.

2. The dowel of claim 1, wherein the reflective marker is provided in the form of a stripe.

3. The dowel of claim 1, wherein the marker is provided in the form of an applied coating on the cylindrical rod.

4. The dowel of claim 1, wherein the marker is provided in the form of a tape layer adhered to the cylindrical rod.

5. The dowel of claim 1, wherein the reflective marker is provided about only a portion of a circumference of the cylindrical rod.

6. The dowel of claim 5, wherein the portion is about 45% of the circumference of the cylindrical rod.

7. A method of aligning a plurality of dowels for construction of a concrete road on a road bed, the method including:

locating a marker on the road bed that indicates a position of a cut line to be placed on the concrete road;

positioning a first dowel of the plurality of dowels above the road bed, wherein the first dowel includes a first reflective alignment stripe thereon;

positioning a second dowel of the plurality of dowels above the road bed, wherein the second dowel includes a second reflective alignment stripe thereon; and aligning the first reflective alignment stripe and second reflective alignment stripe with the marker in a straight line.

8. The method of claim 7 including shining a light on the first reflective alignment stripe and the second reflective alignment stripe.

9. The method of claim 7 wherein the first and second dowels are provided on a single basket.

10. The method of claim 7 wherein the first and second dowels are provided on separate first and second baskets, respectively.

* * * * *